US007289758B2

(12) United States Patent
Kim et al.

(10) Patent No.: US 7,289,758 B2
(45) Date of Patent: Oct. 30, 2007

(54) FIXING DEVICE AND AN IMAGE FORMING APPARATUS USING THE SAME

(75) Inventors: Jeonghwa Kim, Suwon-si (KR); Hwan-guem Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/412,095

(22) Filed: Apr. 27, 2006

(65) Prior Publication Data

US 2007/0092313 A1 Apr. 26, 2007

(30) Foreign Application Priority Data

Oct. 24, 2005 (KR) ..... 10-2005-0100345

(51) Int. Cl.
*G03G 15/20* (2006.01)

(52) U.S. Cl. ..... 399/329; 399/328

(58) Field of Classification Search ..... 399/329, 399/328

See application file for complete search history.

(56) References Cited

U.S. PATENT DOCUMENTS

2003/0103788 A1* 6/2003 Yura et al. ..... 399/329

FOREIGN PATENT DOCUMENTS

| | | |
|---|---|---|
| JP | 10-207277 | 8/1998 |
| JP | 2003-280439 | 10/2003 |
| JP | 2004-077871 | 3/2004 |
| JP | 2004-093759 | 3/2004 |
| JP | 2005-115026 | 4/2005 |

* cited by examiner

*Primary Examiner*—David M. Gray
*Assistant Examiner*—Bryan Ready
(74) *Attorney, Agent, or Firm*—Stein, McEwen & Bui, LLP

(57) ABSTRACT

An image fixing unit includes a heating roller, a pressing roller forming a first fixing nip by contact with an outer surface of the heating roller, and a fixing nip expansion unit forming a second fixing nip by contact with the heating roller. The fixing nip expansion unit includes an auxiliary pressing member mounted at one side of the pressing roller and forming the second fixing nip by contact with the outer surface of the heating roller, an endless belt moving along a caterpillar track surrounding outer circumferences of the heating roller and the auxiliary pressing member, and a resilient unit biasing the heating roller and the auxiliary pressing member resiliently toward the heating roller.

28 Claims, 6 Drawing Sheets

FIXING DEVICE AND AN IMAGE FORMING APPARATUS USING THE SAME

CROSS-REFERENCE TO RELATED APPLICATIONS

This application claims the benefit under 35 U.S.C. §119 (a) of Korean Patent Application No. 2005-100345, filed Oct. 24, 2005, in the Korean Intellectual Property Office, the disclosure of which is incorporated herein by reference.

BACKGROUND OF THE INVENTION

1. Field of the Invention

Aspects of the present invention relate to a fixing device and an image forming apparatus. More particularly, aspects of the present invention relate to a fixing device that transforms an electrostatic latent image formed on a photoconductive medium into a toner image, transfers the toner image onto a recording medium, and fixes the transferred image on the recording medium by heat and pressure, and an image forming apparatus using the same.

2. Description of the Related Art

A fixing device is an essential part of electrophotographic image forming apparatuses such as a copiers, facsimile machines, and laser printers, since it creates a fixed image on a recording medium and determines the final image quality.

FIG. 1 illustrates the structure of a conventional fixing device as disclosed in Japanese Patent Publication No. 2003-280439.

Referring to FIG. 1, a conventional fixing device 20 comprises a fixing roller 21 coated with an elastic layer on the surface as a belt base material, a heating roller 23 having therein a heating source 22 such as a halogen lamp, and an auxiliary roller 24 assisting separation. Also, a fixing belt 25 winds around the fixing rollers 21, the heating roller 23, and the auxiliary roller 24 in a triangle-shaped path. Furthermore, a pressing roller 26 by which a pressure welding is carried out against the fixing roller 21 is formed in the fixing device 20, and a heating source 27 is built also into the pressing roller 26. The location which the pressure welding by the pressing roller 26 is carried out against the fixing roller 21 is referred to as a fixing nip.

A recording medium P which supports a non-fixed toner image is conveyed to the fixing device 20 by moving in the direction of the arrow-head A. The recording medium P is supported by a guide member 28 as it moves toward the fixing device. In addition, a press member 40 presses the fixing belt 25 between the fixing roller 21 of the fixing belt 25 and the auxiliary roller 24.

In the above-structured fixing device 20, when the leading end of the recording medium P has passed through the fixing nip, the leading edge of the recording medium is conveyed to a nip between the fixing belt 25 and the pressing member 40. Since the fixing belt 25 is bent as the recording medium P passes through the nip, the leading end of the recording medium P is separated from the fixing belt 25 and moved along a peripheral surface of the pressing member 40, and the separability of the recording medium P with respect to the fixing belt 25 is thus improved. A guide member 30 guides the movement of the recording medium P after the recording medium P passes the pressing member 40. An elastic member 33 elastically supports the heating roller 23.

FIG. 2 is an enlarged view showing a structure of a conventional image fixing device.

Referring to FIG. 2, an image fixing device 50 comprises a heating roller 51 having therein a heating source 51*a*, for example, a halogen lamp, and a pressing roller 53 forming a contact nip N by contact with the heating roller 51.

The heating roller 51 comprises a core pipe 51*b* and an elastic rubber layer 51*c* coated on an outer surface of the core pipe 51*b*.

The pressing roller 53 comprises a metal core pipe 53*b* and an elastic rubber layer 53*c* coated on an outer surface of the metal core pipe 53*b*.

In the above-structured fixing device, before the image fixing process, the fixing nip N of the fixing device needs to be heated up to a predetermined fixing temperature and kept at the fixing temperature.

According to the related art, the core pipe 51*b* of the heating roller 51 is heated by calorific operation of the heating source 51*a*, and the heat is conducted up to the elastic rubber layer 51*c*, thereby heating and keeping the elastic rubber layer 51*c* at the predetermined fixing temperature. As a non-fixed toner image formed on the recording medium P passes through the fixing nip N, the toner image is heated and pressurized, thereby being fixed on the recording medium P.

When color-electrophotographic image forming apparatuses are used in high-speed operations, it is necessary to increase the outer diameters of the rollers 51 and 53 or the thickness of the elastic rubber layers 51*c* and 53*c* to expand the width of the fixing nip N. Otherwise, in a high speed operation, as the printing speed increases, the fixing quality deteriorates due to a decreased staying time of a recording medium P at the fixing nip N.

However, increase in the diameters of the rollers 51 and 53 increases the whole size of the apparatus, increases the warming-up time, and increases the manufacturing cost.

Moreover, when the thickness of the elastic rubber layers 51*c* and 53*c* is increased, the warming-up time is increased. Furthermore, the inner temperature of the core pipe 51*b* needs to be much higher so as to maintain the fixing temperature of the thickened elastic rubber layer 51*c*. The higher temperature causes the surface of the core pipe 51*b*, the contacting part between the core pipe 51*b* and the elastic rubber layer 51*c*, or the elastic rubber layer 51*c* to deteriorate. Also, durability of these parts is decreased.

In order to ensure the fixing quality in a high-speed image forming apparatus, the pressure applied to the fixing nip N may be increased. However, too much pressure at the fixing nip N would deform the elastic rubber layers 51*c* and 53*c*, thereby reducing their durability. Furthermore, paper jams would occur more frequently because the recording medium P cannot move smoothly. Moreover, as the driving torque increases, the apparatus may be damaged. Moreover, when the pressing member has a relatively small length, the pressing member may be deformed or bent by the high pressure, thereby considerably reducing the width of the fixing nip N at the center portion compared to the opposite end portions. In this case, evenness of the fixing nip N through the whole length cannot be obtained.

FIG. 3 is a graph illustrating the distribution of pressure at the fixing nip N in the conventional fixing device.

Referring to FIG. 3, the distribution of pressure at the fixing nip N is symmetrical between an inlet I and an outlet O. Therefore, when the recording medium P passes through the outlet O, a printed side of the recording medium P may adhere to the surface of the heating roller 51 and roll up. This phenomenon is called 'wrap jam'.

SUMMARY OF THE INVENTION

An aspect of the present invention is to solve at least the above problems and/or disadvantages and to provide at least the advantages described below. Accordingly, an aspect of the present invention is to provide a fixing device capable of expanding a fixing nip.

Another aspect of the present invention is to provide an image forming apparatus including the above fixing device.

Additional aspects and/or advantages of the invention will be set forth in part in the description which follows and, in part, will be obvious from the description, or may be learned by practice of the invention.

According to a first embodiment, there is provided a fixing device comprising a heating roller; a pressing roller forming a first fixing nip by contact with an outer surface of the heating roller; and a fixing nip expansion unit forming a second fixing nip by contact with the heating roller.

According to an aspect of the invention, the fixing nip expansion unit comprises an auxiliary pressing member mounted at one side of the pressing roller and forming the second fixing nip by contact with the outer surface of the heating roller; an endless belt moving along a caterpillar track surrounding outer circumferences of the pressing roller and the auxiliary pressing member; and a resilient unit biasing the pressing roller and the auxiliary pressing member resiliently toward the heating roller.

According to an aspect of the invention, the auxiliary pressing member comprises a support body having a plate form and forming a predetermined nip by contact with an outer surface of the heating roller; and a resilient body coated on one side of the support body opposed to the heating roller.

According to an aspect of the invention, the support body comprises a nip formation unit, and a belt support unit that is bent at one side of the nip formation unit by a predetermined angle to support the endless belt.

According to an aspect of the invention, the resilient body is made of one of silicon rubber, urethane, and foamed resin.

According to an aspect of the invention, the support body is made of robust or rigid material capable of enduring tension of the endless belt, such as metal and high-molecular substance.

Preferably, but not necessarily, pressure applied to the pressing roller and the auxiliary pressing member is not symmetrically distributed. According to an aspect of the invention, the auxiliary pressing member is disposed at an upper stream of the first fixing nip, and the pressure of the pressing roller is greater than the pressure of the auxiliary pressing member. In addition to, a nip pressure applied to discharge side of a recording medium is greater than a nip pressure applied to entrance side of the recording medium, based on a direction that the recording medium moves through the fixing device.

According to an aspect of the invention, the resilient unit comprises a first spring connecting an axis of the heating roller and the pressing roller; and a second spring connecting an axis of the heating roller and the auxiliary pressing member.

According to an aspect of the invention, the resilient unit comprises a first support spring connected to an axis of the pressing roller to resiliently support the pressing roller toward the heating roller; and a second support spring connected to the auxiliary pressing member to resiliently support the auxiliary pressing member toward the heating roller.

According to another embodiment, there is provided a full-color image forming apparatus applying the above-configured image fixing device.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
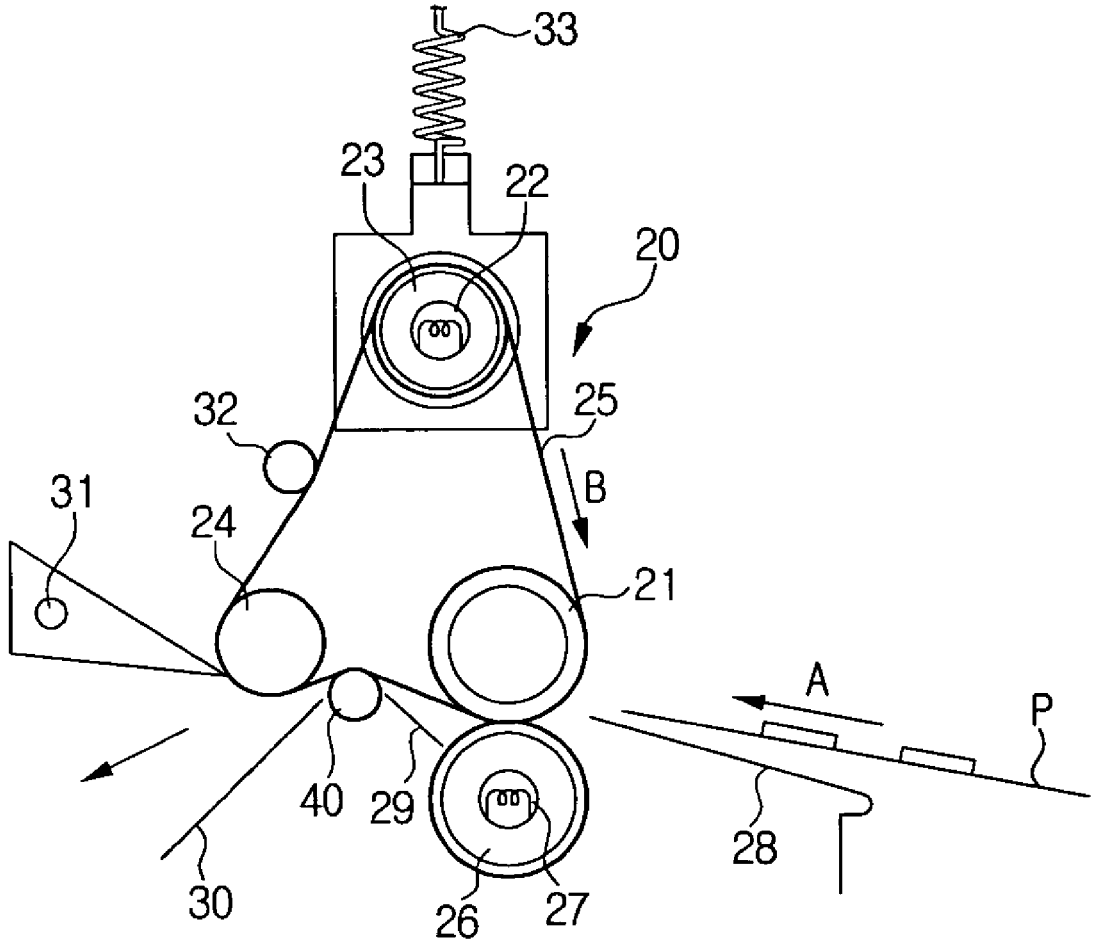
FIG. 1 (PRIOR ART)
FIG. 1 shows a conventional image fixing device as disclosed in Japanese Patent Publication No. 2003-280439.
Figure 2:
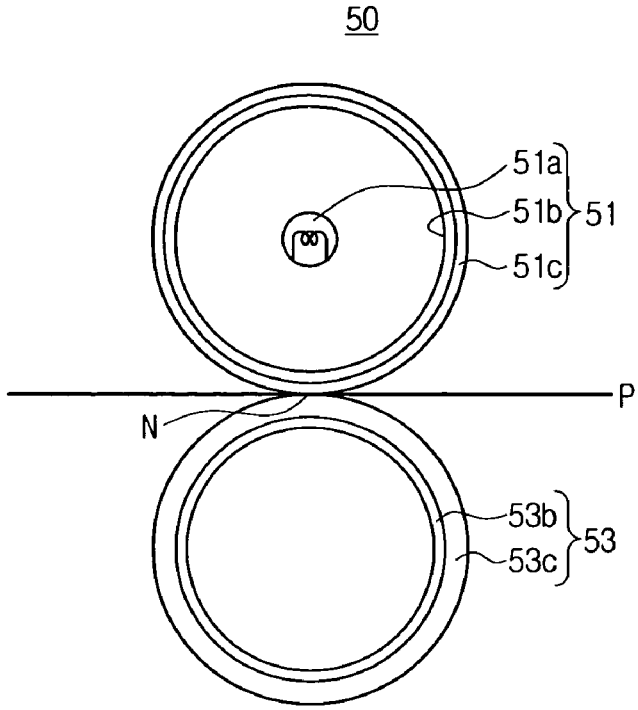
FIG. 2 (PRIOR ART)
FIG. 2 is an enlarged view showing the structure of a conventional image fixing device.
Figure 3:
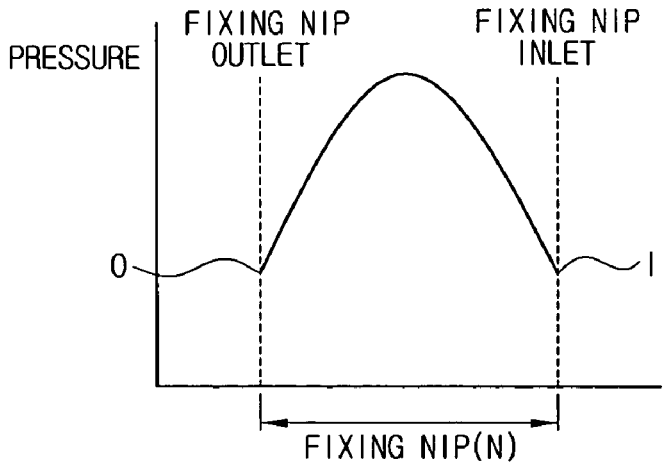
FIG. 3 (PRIOR ART)
FIG. 3 is a graph illustrating the distribution of pressure applied at a fixing nip of the conventional image fixing device.

Reference will now be made in detail to the present embodiments of the present invention, examples of which are illustrated in the accompanying drawings, wherein like reference numerals refer to the like elements throughout. The embodiments are described below in order to explain the present invention by referring to the figures. Well-known functions or constructions are not described in detail since they would obscure the invention in unnecessary detail.

Figure 4:
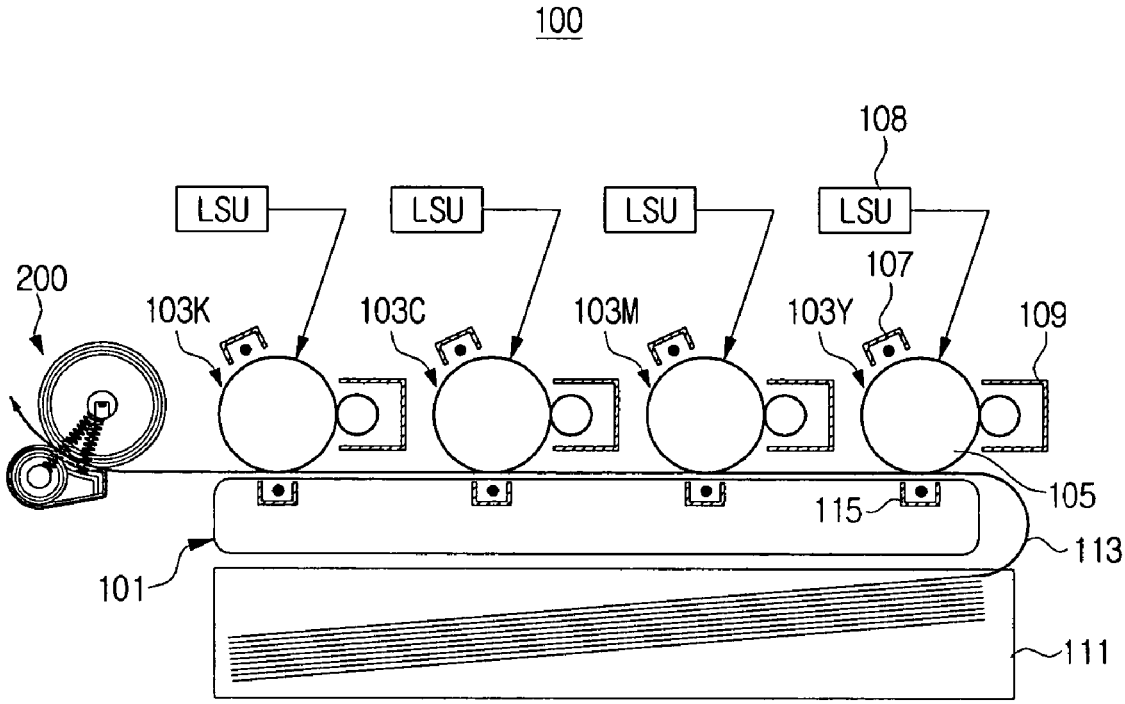
FIG. 4 is a view schematically showing the structure of an image forming apparatus including an image fixing device according to an embodiment of the present invention.

FIG. 4 schematically shows the structure of an image forming apparatus that includes an image fixing device according to an embodiment of the present invention.

Referring to FIG. 4, the image forming apparatus 100 is a tandem-type color image forming apparatus that comprises four image formation units 103Y, 103M, 103C and 103K arranged on a belt transfer unit 101 to form toner images of four colors such as yellow, magenta, cyan and black. The image formation units 103Y, 103M, 103C and 103K, respectively, each comprise a photoconductive drum 105, an electrifying unit 107 electrically charging the photoconductive drum 105, and a laser scan unit 108 scanning a surface of the electrically charged photoconductive drum 105 with a laser beam corresponding to image information. An electrostatic latent image is formed on the photoconductive drum 105 by the laser beam and developed through a developing unit 109 into a visible toner image.

A recording medium 113, such as, for example, paper, is supplied from a recording medium supply cassette 111 and conveyed by the belt transfer unit 101. Typically, the recording medium is paper, particularly sheets of paper. However, it is to be understood other printing media can be used. In particular, any other printing medium, such as, for example, plastic or textile, that is in a form that can be supplied in an image forming apparatus and fixed with a printed image can be used according to an aspect of the present invention. The toner image is transferred onto the recording medium 113 through a transfer unit 115.

In the color image forming apparatus, a yellow toner image formed by the yellow image formation unit 103Y is transferred onto the recording medium 113. Meanwhile, an electrostatic latent image corresponding to a magenta portion of an object to be copied or printed is formed on the magenta image formation unit 103M, and a magenta toner image is formed by the developing unit 109. The magenta toner image is transferred onto the recording medium 113 onto which the yellow toner image was transferred, and overlaps with the yellow toner image. Cyan and black toner images are formed in the same manner as described above. Therefore, four colors of toner images overlap on the recording medium 113. The recording medium 113 having the four colors of toner images thereon is separated from the belt transfer unit 101 and conveyed to an image fixing unit 200. The toner image 113*a* transferred on the conveyed recording medium 113 is fixed by heat and pressure applied by the image fixing device 200.

Figure 5:
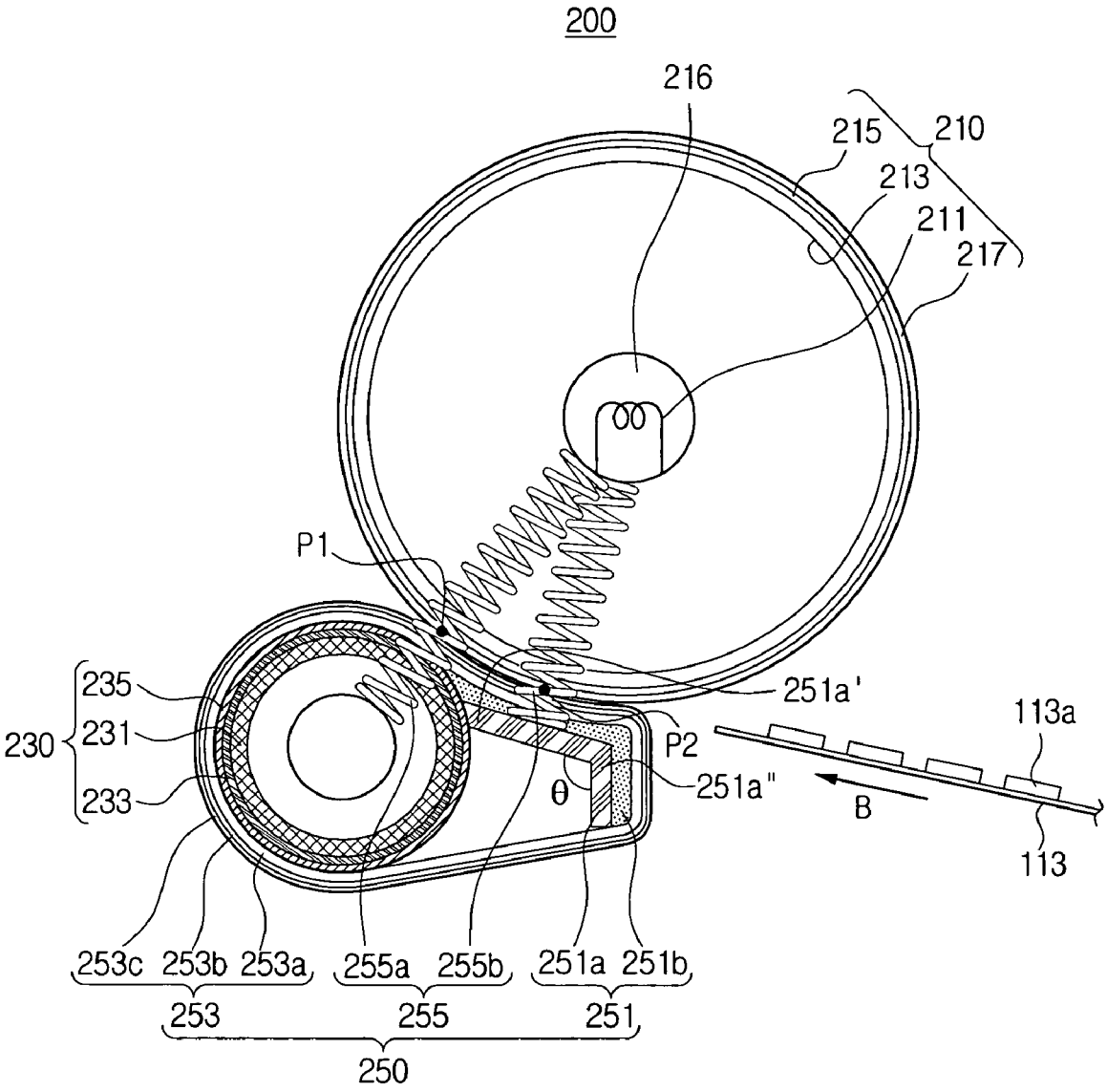
FIG. 5 is a view showing the structure of the image fixing unit of FIG. 4.

FIG. 5 is a view showing the structure of the image fixing device of FIG. 4.

Referring to FIG. 5, the image fixing device 200 comprises a heating roller 210, a pressing roller 230 forming a first fixing nip P1 by contact with an outer surface of the heating roller 210, and a fixing nip expansion unit 250 forming a second fixing nip P2 by contact with the heating roller 210.

The heating roller 210 has a heating source 211 built therein. The heating roller 210 also comprises a core pipe 213 made of a rigid material such as, for example, aluminum alloy or stainless steel, and an elastic layer 215 coated on an outer surface of the core pipe 213. As a non-limiting example, the elastic layer 215 may be made of rubber. A toner adhesion prevention layer 217 may be further formed on an outer surface of the elastic layer 215 to prevent the toner from adhering on the outer surface of the elastic layer 215.

The pressing roller 230 presses the heating roller 210 and accordingly, the first fixing nip P1 is formed between the pressing roller 230 and the heating roller 210. Similar to the heating roller 210, the pressing roller 230 comprises a core pipe 231 made of a rigid material such as, for example, metal and an elastic layer 233, which, as a non-limiting example, may be made of rubber. A toner adhesion prevention layer 235 may be added on an outer surface of the elastic layer 233.

The fixing nip expansion unit 250 comprises an auxiliary pressing member 251 mounted at one side of the pressing roller 230 and forming the second fixing nip P2 by contact with the outer surface of the heating roller 210, an endless belt 253 moving along the outer circumferences of the pressing roller 230 and the auxiliary pressing member 251, such as, for example, along a caterpillar track, and a resilient unit 255 biasing the pressing roller 230 and the auxiliary pressing member 251 resiliently toward the heating roller 210.

The auxiliary pressing member 251 comprises a support body 251*a* having a plate form and forming a predetermined nip by contact with an outer surface of the pressing roller 230, and a resilient body 251*b* coated on one side of the support body 251*a* opposed to the heating roller 210.

The support body 251*a* comprises a nip formation unit 251*a*' opposed to the heating roller 210, and a belt support unit 251*a*" that is bent at one side of the nip formation unit 251*a*' by a predetermined angle θ (for example, 90°<θ<180°) and that supports the endless belt 253. The nip formation unit 251*a*' is bent by the predetermined angle θ in order to prevent discontinuity with respect to the heating roller 210 by enabling the pressure to increase from the second fixing nip P2 toward the first fixing nip P1.

The elastic body 251*b* may comprise any suitable elastic material such as, for example, silicon rubber, urethane, or foamed resin. The support body 251*a* may comprise a robust or rigid material capable of enduring tension of the endless belt 253, and may be a material such as metal or a high-molecular substance. That is, the support body 251*a* should be made of a material that is strong enough so that the support body does not bend or buckle when tension is applied by the endless belt. The term "high-molecular substance" refers to a high molecular weight substance such as, for example, an organic high molecular weight polymer. If the support body 251*a* is in direct contact with the heating roller 210 through the endless belt 253, the support body 251*a* may be made of metal to provide prompt thermal responsiveness.

The auxiliary pressing member 251 is mounted upstream of the fixing nip P1. As used herein, the term "upstream" and "downstream" are used with reference to the direction in which the recording medium moves as it is fed to the image fixing device as shown arrow B in FIG. 6. Preferably, but not necessarily, the pressing roller 230 and the auxiliary pressing member 251 are arranged in a manner such that pressure is unsymmetrically distributed. For example, the pressure of the pressing member 230 against the heating roller 210 may be greater than the pressure of the auxiliary pressing member 251 against the heating roller 210 such that discharge and conveyance of the recording medium 113 is facilitated. To provide for selected pressures, the spring coefficients of the different portions of the resilient unit 255 may be selected, as will be described hereinafter. For example, the pressure at the pressing roller 230 may be set to 6~12 Kgf and the pressure at the auxiliary pressing member 251 may be set to 3~5 Kgf.

The endless belt 253 comprises a base layer 253*a* and an elastic layer 253*b* coated on one side of the base layer 253*a*. As non-limiting examples, the base layer 253*a* may comprise a high-molecular substance or metal. The term "high-molecular substance" refers to a high molecular weight substance such as, for example, an organic high molecular weight polymer. As a non-limiting example, the elastic layer 253*b* may be rubber.

As non-limiting examples, polyimide (PI) and poly ether ether ketone (PEEK) may be used as the high-molecular substance. As non-limiting examples, Ni, Ni alloy, stainless steel, Al, Al alloy, Cu, and Cu alloy may be used as the metal.

When configuring the endless belt 253, a toner adhesion prevention layer 253*c* may be provided on the outer surface of the elastic layer 253*b*. The toner adhesion prevention layer 253*c* may comprise high-molecular substance such as, for example, perfluoro alkoxyl (PFA).

The resilient unit 255 comprises a first spring 255*a* connecting an axis 216 of the heating roller 210 with the pressing roller 253, and a second spring 255*b* connecting the axis 216 of the heating roller 210 with the auxiliary pressing member 251. Tension springs may be used for the first and the second springs 255*a* and 255*b*.

Figure 6:
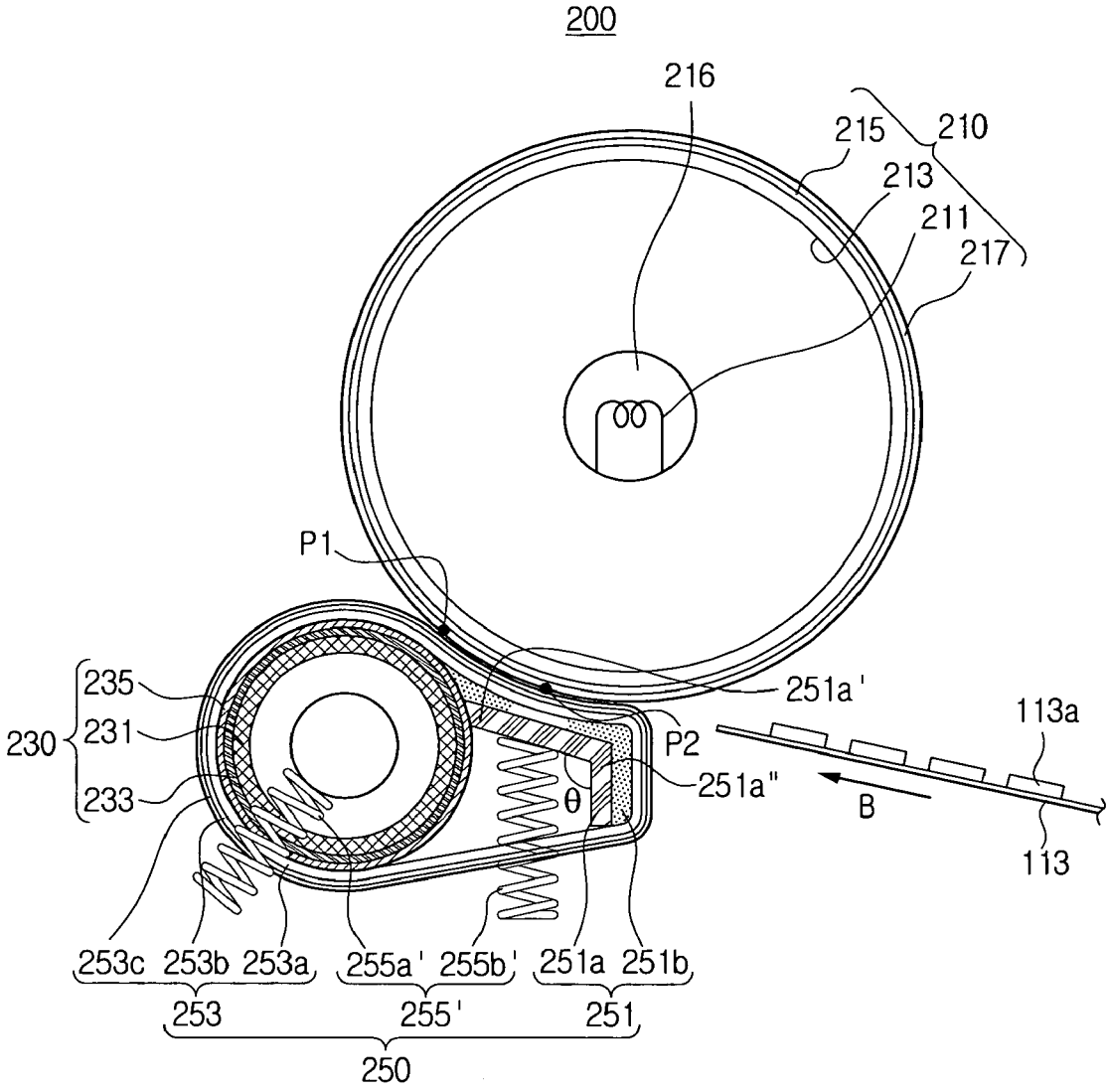
FIG. 6 is a view showing another example of a resilient unit applied to the present invention.

Another embodiment for the resilient member 255 is illustrated in FIG. 6.

Referring to FIG. 6, the resilient unit 255 comprises a first support spring 255*a*' connected to the axis of the pressing roller 230 by one end thereof to resiliently support the pressing roller 230 toward the heating roller 210, and a second support spring 255*b*' connected to the auxiliary pressing member 251 by one end thereof to resiliently support the auxiliary pressing member 251 toward the heating roller 210. In this case, the other ends of the first and the second support springs 255*a*' and 255*b*' are fixed by a dedicated support unit (not shown).

Now, the operation of the above-structured image fixing device will be described.

Figure 7:
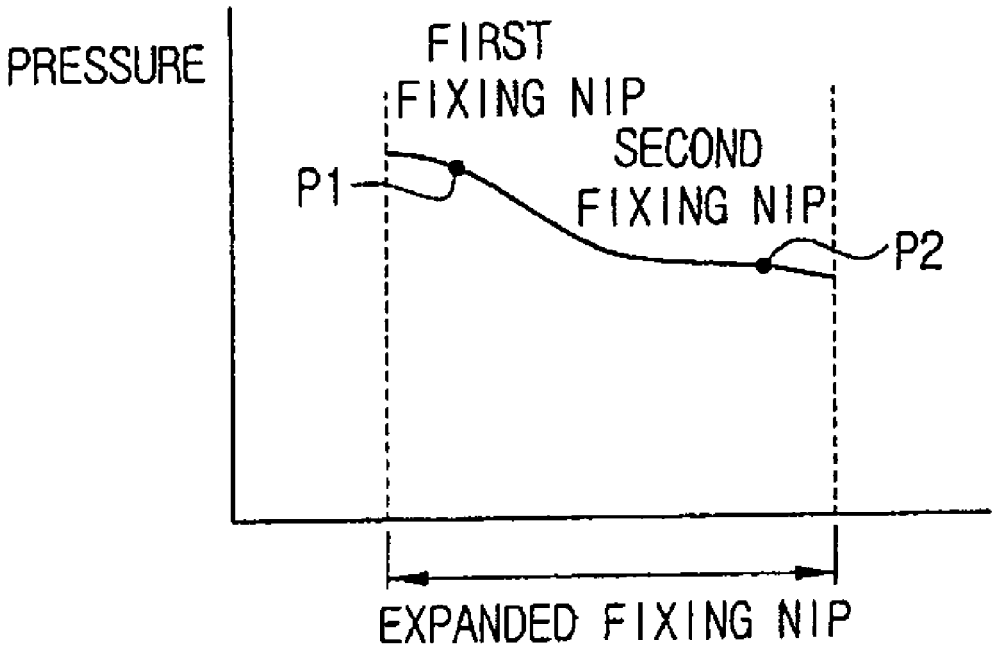
FIG. 7 is a graph illustrating the distribution of pressure applied to a fixing nip formed at the image fixing device according to an embodiment of the present invention.

FIG. 7 is a graph illustrating the distribution of pressure with respect to the expanded fixing nip formed by the image fixing device.

Before starting the fixing process, the fixing nip is heated to a predetermined fixing temperature so as to fix the toner image 113*a*. For this, radiation heat from the heating source 211, such as the halogen lamp, is transmitted to the core pipe 213, thereby heating and keeping the elastic layer 215 at the predetermined fixing temperature. In order to control the heating roller 210, a temperature sensing element may be mounted contactingly or non-contactingly on the outer surface of the heating roller 210. Alternatively, the temperature sensing element may be mounted contactingly or non-contactingly on an inner surface of the endless belt 253.

When the fixing temperature at the fixing nip is reached, the endless belt 253 is run in association with either the heating roller 210 or the pressing roller 230. The recording medium 113 is passed through the second and the first fixing nips P2 and P1 sequentially, and the toner image 113*a* transferred on the recording medium 113 is heated and fixed. Here, since the support body 251*a* of the auxiliary pressing member 251 is slanted by the predetermined angle, discontinuity between the recording medium 113 and the heating roller 210 does not occur. The second and first fixing nips P2 and P1 together form an expanded fixing nip such that the recording medium 113 can stay longer at the fixing nip. Meanwhile, since the pressure at the pressing roller 230 may be designed to be greater than the pressure at the auxiliary pressing member 251 as shown in FIG. 7, a printed side of the recording medium 113, bearing the toner image 113*a*, can be easily separated without rolling up toward the heating roller 210. (Wrap jam is less likely to occur.)

According to the above-described image fixing device, width of the fixing nip can be expanded using the belt system, and it is not necessary to use over-sized rollers, thereby realizing compactness of the device. Furthermore, by using the simply structured pressing member, expansion of the width of the fixing nip can be achieved cost-effectively.

In addition, as the fixing nip is expanded, a staying time of the recording medium at the fixing nip is increased, thereby improving printing quality. Also, a warming-up time can be improved by setting the fixing temperature low.

The lower fixing temperature and lower pressure at the fixing nip improve the lifespan of component parts.

Furthermore, the recording medium can be easily separated at the outlet of the fixing nip without causing the wrap jam, by applying the pressure of the auxiliary pressing member unsymmetrically. Also, distortion of the auxiliary pressing member is prevented, thereby improving the lifespan of the apparatus.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A fixing device comprising:

a heating roller;

a pressing roller forming a first fixing nip by contact with an outer surface of the heating roller;

an auxiliary pressing member mounted at one side of the pressing roller and forming a second fixing nip by contact with the outer surface of the heating roller;

an endless belt surrounding outer circumferences of the pressing roller and the auxiliary pressing member; and a resilient unit biasing the pressing roller and the auxiliary pressing member resiliently toward the heating roller, wherein the resilient unit comprises a first spring connecting an axis of the heating roller and the pressing roller; and a second spring connecting an axis of the heating roller and the auxiliary pressing member, wherein the auxiliary pressing member comprises, a support body having a plate form and forming a predetermined nip by contact with an outer surface of the heating roller, and wherein, in an operation of the fixing device:

the heating roller faces a recording medium at a side of the recording medium having a toner image, the pressing roller faces the recording medium at a side of the recording medium that does not have the toner image, and a pressing force of the pressing roller is greater than a pressing force of the auxiliary pressing member.

2. The fixing device of claim 1, wherein the pressing roller and the support body are adjacent to each other such that the first fixing nip and the second fixing nip together form an expanded fixing nip.

3. The fixing device of claim 1, wherein the auxiliary pressing member comprises a resilient body coated on one side of the support body opposed to the heating roller.

4. The fixing device of claim 1, wherein the support body comprises a nip formation unit, and a belt support unit that is bent at one side of the nip formation unit by a predetermined angle to support the endless belt.

5. The fixing device of claim 3, wherein the resilient body is made of one of silicon rubber, urethane, and foamed resin.

6. The fixing device of claim 1, wherein the support body is made of rigid material capable of enduring tension of the endless belt.

7. The fixing device of claim 6, wherein the rigid material comprises one of metal and a high-molecular substance.

8. The fixing device of claim 1, wherein pressure applied to the pressing roller and the auxiliary pressing member is not symmetrically distributed.

9. The fixing device of claim 8, wherein a nip pressure applied to a discharge side of a recording medium is greater than a nip pressure applied to an entrance side of the recording medium, based on a direction that the recording medium moves through the fixing device.

10. The fixing device of claim 1, wherein the auxiliary pressing member is disposed upstream of the first fixing nip, based on a direction that a recording medium moves through the fixing device.

11. The fixing device of claim 8, wherein the pressure applied to the pressing roller is greater than the pressure applied to the auxiliary pressing member.

12. The fixing device of claim 8, wherein the pressure applied to the pressing roller and the pressure applied to the auxiliary pressing member are selected so that a likelihood of wrap jam of a printing medium during an operation of the image fixing device is reduced.

13. The fixing device of claim 1, wherein the pressing roller comprises a core pipe made of a rigid material, an elastic layer on an outer surface of the core pipe and a toner adhesion prevention layer on an outer surface of the elastic layer.

14. The fixing device of claim 1, wherein the heating roller comprises a core pipe made of a rigid material, an elastic layer on an outer surface of the core pipe and a toner adhesion prevention layer on an outer surface of the elastic layer.

15. An image forming apparatus comprising:

at least one photoconductive drum on which a predetermined electrostatic latent image is formed;

at least one image formation unit developing the electrostatic latent image formed on the at least one photoconductive drum into a visible image;

a transfer unit facing the at least one photoconductive drum to transfer the visible image formed on the at least one photoconductive drum onto a recording medium; and an image fixing unit heating and pressing the image transferred through the transfer unit on the recording medium, wherein the image fixing unit comprises a heating roller, a pressing roller forming a first fixing nip by contact with an outer surface of the heating roller, an auxiliary pressing member mounted at one side of the pressing roller and forming a second fixing nip by contact with the outer surface of the heating roller, an endless belt surrounding outer circumferences of the pressing roller and the auxiliary pressing member, and a resilient unit biasing the heating roller and the auxiliary pressing member resiliently toward the heating roller, wherein the resilient unit comprises a first spring connecting an axis of the heating roller and the pressing roller; and a second spring connecting an axis of the heating roller and the auxiliary pressing member, wherein the auxiliary pressing member comprises a support body having a plate form and forming a predetermined nip by contact with an outer surface of the pressing roller, and wherein, in an operation of the fixing device:

the heating roller faces a recording medium at a side of the recording medium having a toner image, the pressing roller faces the recording medium at a side of the recording medium that does not have the toner image, and a pressing force of the pressing roller is greater than a pressing force of the auxiliary pressing member.

16. The image forming apparatus of claim 15, wherein the pressing roller and the support body are adjacent to each other such that the first fixing nip and the second fixing nip together form an expanded fixing nip.

17. The image forming apparatus of claim 15, wherein the auxiliary pressing member comprises a resilient body coated on one side of the support body opposed to the heating roller.

18. The image forming apparatus of claim 15, wherein the support body comprises a nip formation unit, and a belt support unit that is bent at one side of the nip formation unit by a predetermined angle to support the endless belt.

19. The image forming apparatus of claim 17, wherein the resilient body is made of one of silicon rubber, urethane, and foamed resin.

20. The image forming apparatus of claim 15, wherein the support body is made of rigid material capable of enduring tension of the endless belt.

21. The image forming apparatus of claim 20, wherein the rigid material comprises one of metal and a high-molecular substance.

22. The image forming apparatus of claim 15, a pressure applied to the pressing roller and the auxiliary pressing member is not symmetrically distributed.

23. The image forming apparatus of claim 21, wherein a nip pressure applied to a discharge side of a recording medium is greater than a nip pressure applied to an entrance side of the recording medium, based on a direction that the recording medium moves through the fixing device.

24. The image forming apparatus of claim 15, wherein the auxiliary pressing member is disposed upstream of the first fixing nip, based on a direction that a recordinq medium moves throuqh the fixing device.

25. The image forming apparatus of claim 24, wherein the pressure applied to the pressing roller is greater than the pressure applied to the auxiliary pressing member.

26. The image forming apparatus of claim 22, wherein the pressure applied to the pressing roller and the pressure applied to the auxiliary pressing member are selected so that a likelihood of wrap jam of a printing medium during an operation of the image fixing device is reduced.

27. The image forming apparatus of claim 15, wherein the pressing roller comprises a core pipe made of a rigid material, an elastic layer on an outer surface of the core pipe and a toner adhesion prevention layer on an outer surface of the elastic layer.

28. The image forming apparatus of claim 15, wherein the heating roller comprises a core pipe made of a rigid material, an elastic layer on an outer surface of the core pipe and a toner adhesion prevention layer on an outer surface of the elastic layer.

* * * * *

UNITED STATES PATENT AND TRADEMARK OFFICE

CERTIFICATE OF CORRECTION

PATENT NO. : 7,289,758 B2
APPLICATION NO. : 11/412095
DATED : October 30, 2007
INVENTOR(S) : Jeong-wha Kim et al.

It is certified that error appears in the above-identified patent and that said Letters Patent is hereby corrected as shown below:

Column 10, line 29, change “recordinq” to --recording--.

Column 10, line 30, change “throuqh” to --through--.

Signed and Sealed this

Eighteenth Day of December, 2007

JON W. DUDAS
*Director of the United States Patent and Trademark Office*